US009976247B2

(12) United States Patent
Cinello et al.

(10) Patent No.: US 9,976,247 B2
(45) Date of Patent: May 22, 2018

(54) LAUNDRY MACHINE WITH VERSATILE TUB

(71) Applicant: Electrolux Home Products Corporation N.V., Brussels (BE)

(72) Inventors: Mauro Cinello, Codroipo (IT); Vittorio Perosa, Gruaro (IT); Stefano De Paoli, Fiume Veneto (IT); Giovanni Colombera, Sacile (IT); Marco Monacchi, Porcia (IT); Marco Clara, Pordenone (IT); Marco Pessot, Pordenone (IT); Davide Morosi, Fiume Veneto (IT)

(73) Assignee: Electrolux Home Products Corporation N.V. (BE)

( * ) Notice: Subject to any disclaimer, the term of this patent is extended or adjusted under 35 U.S.C. 154(b) by 1 day.

(21) Appl. No.: 14/653,922

(22) PCT Filed: Dec. 13, 2013

(86) PCT No.: PCT/EP2013/076622
§ 371 (c)(1),
(2) Date: Jun. 19, 2015

(87) PCT Pub. No.: WO2014/095667
PCT Pub. Date: Jun. 26, 2014

(65) Prior Publication Data

US 2016/0186371 A1 Jun. 30, 2016

(30) Foreign Application Priority Data

Dec. 21, 2012 (EP) ..... 12198891

(51) Int. Cl.
*D06F 39/08* (2006.01)
*D06F 37/26* (2006.01)

(52) U.S. Cl.
CPC ..... *D06F 39/083* (2013.01); *D06F 37/267* (2013.01)

(58) Field of Classification Search
CPC ..... D06F 37/267; D06F 39/083
See application file for complete search history.

(56) References Cited

U.S. PATENT DOCUMENTS 2,034,244 A * 3/1936 Mikulasek ..... D06F 13/00 366/278
2,389,774 A * 11/1945 Haberstump ..... D06F 39/12 220/4.02

(Continued)

FOREIGN PATENT DOCUMENTS

EP 1746193 A1 1/2007
JP S56176692 U 12/1981

(Continued)

OTHER PUBLICATIONS

International Search Report dated May 2, 2014 issued in corresponding International Application No. PCT/EP2013/076622.

*Primary Examiner* — Joseph L. Perrin
(74) *Attorney, Agent, or Firm* — RatnerPrestia

(57) ABSTRACT

A laundry machine for treating laundry is provided with a tub which includes a discharge hole for draining liquid out of the tub, and a plurality of drain-connection elements. The laundry machine further includes a discharge duct fluidly connected to the discharge hole for collecting liquid drained from the tub, and fixed to the tub by at least one of the drain-connection elements. The plurality of drain-connection elements include at least two different types of drain-connection elements, each one adapted for fixing a corresponding type of discharge duct to the tub by means of a corresponding connection arrangement.

18 Claims, 7 Drawing Sheets

(56) References Cited

U.S. PATENT DOCUMENTS

| | | | | |
|---|---|---|---|---|
| 2,922,526 | A * | 1/1960 | Ohmann | D06F 39/083 210/166 |
| 4,423,607 | A * | 1/1984 | Munini | D06F 37/20 220/675 |
| 5,988,699 | A * | 11/1999 | Quandt | F16L 41/086 285/142.1 |
| 7,490,869 | B2 * | 2/2009 | Iturralde | D06F 39/083 285/345 |
| 2003/0127855 | A1 * | 7/2003 | Heverly | D06F 39/083 285/227 |
| 2004/0244438 | A1 | 12/2004 | North | |
| 2007/0018453 | A1 * | 1/2007 | Iturralde | D06F 39/083 285/220 |
| 2007/0175245 | A1 * | 8/2007 | Kim | B29C 45/37 68/140 |
| 2011/0023557 | A1 * | 2/2011 | Borque Marquina | B29C 45/0025 68/142 |

FOREIGN PATENT DOCUMENTS

| | | | |
|---|---|---|---|
| JP | S6171098 | A | 4/1986 |
| WO | 2007115894 | A1 | 10/2007 |

* cited by examiner

LAUNDRY MACHINE WITH VERSATILE TUB

Aspects of the present invention relate to laundry machines, such as laundry washing machines and laundry washing/drying machines, both for domestic and professional use. More particularly, certain aspects relate to a laundry machine having a versatile tub, allowing multiple types of connections of a discharge duct of the draining system.

BACKGROUND

A household and/or professional laundry machine—such as a laundry washing machine and a laundry washing/drying machine—typically comprises a washing tub, enclosed in a casing, that houses a rotatable drum in which the laundry can be loaded/unloaded, and accessible by a user for loading/unloading the laundry through a loading/unloading aperture selectively closable by a door.

During operation, washing liquid (e.g., water or water mixed with washing/rinsing products) is introduced in the tub of the laundry machine by means of an inlet hydraulic system fluidly connected to the tub. Subsequently, a washing phase starts in which the laundry previously loaded into the rotatable drum is washed thanks to the chemical reactions exerted by the washing liquid, supported by the tumbling action caused by the rotation of the drum.

At the end of the washing phase, waste liquid (i.e., the washing liquid mixed with dirt particles removed from the laundry and possibly fluff lost therefrom) is drained from the washing tub before starting a rinsing phase of the washed laundry typically followed by a spin-drying phase. Furthermore, also additional waste liquid expelled from the washed laundry during the spin-drying or rinsing phase is discharged at the end of the laundry machine operation in order to avoid waste liquid stagnation, correlated unpleasant smells and dirt deposits within the drum and/or the tub.

Therefore, the laundry machine is provided with a draining system adapted to drain waste liquid during the operation of the laundry machine. Particularly, such draining system is selectively fluidly connected to the tub of the laundry machine in order to receive the waste liquid.

The draining system usually comprises a discharge duct (such as a flexible hose), which, at one of its ends, is connected to a discharge hole at the bottom of the washing tub for discharging the waste liquid. At the other end, the discharge duct is connected to a pump assembly adapted to drain the waste liquid from the washing tub. Such a pump assembly usually comprises a filter (for blocking small objects and/or fluff) and a drain pump (that pumps liquid out of the washing tub). A valve member is usually provided in the discharge duct in order to fluidly separate during a washing procedure the draining system from the tub. Finally, a discharge hose connects a pump assembly outlet to a house draining pipe system for disposing the waste liquid.

Typically, the discharge hole is surrounded by a drain collar, which surrounds the discharge hole and is advantageously connected to the discharge duct of the draining system.

As known, the discharge duct has to be properly connected to the tub in order to avoid waste liquid leakages, which may lead to laundry machine malfunctions (e.g., due to waste liquid leakages on electrics or electronics component parts), annoying drawbacks (e.g., waste liquid dispersed on the floor). Many types of discharge ducts are known, each featuring peculiar shapes and constitutive materials. Therefore, it is necessary to use a specific tub adapted to the particular discharge duct type to be mounted thereto.

For example, a flexible hose may be fastened to the drain collar of the tub by means of a hose clamp. Conversely, in the case of a manifold made of hard material, such as a plastic polymer, a hose clamp does not provide a suitable fastening (since the plastic polymer does not deform as the elastomeric material does upon the fastening of the hose clamp) and other expedients have to be applied, such as screwing the manifold to the tub at the drain collar.

Consequently, the discharge hole and the portion of the tub in which the same is provided has to be specifically manufactured according to the discharge duct type (i.e., made of elastomeric or hard material) to be connected to the same, which requires different manufacturing lines or different manufacturing periods on a same manufacturing line. This requires an accurate laundry machines manufacturing planning, which may cause manufacturing costs to increase.

SUMMARY OF SELECTED INVENTIVE ASPECTS

The Applicant has tackled the problem of devising a satisfactory solution able to provide a versatile laundry machine tub adapted to be connected with discharge ducts for draining waste liquid essentially regardless of a type thereof.

Applicant has found that by providing the washing tub of a laundry machine with at least two types of drain-connection elements, each one adapted for fixing a corresponding type of discharge duct to the tub by means of a corresponding connection arrangement, it is possible using a single type of tub in association with different types of discharge ducts, which reduces the production complexity, the necessity of using different machines, tools and moulds, and, therefore, the overall productions costs.

One aspect of the present invention proposes a laundry machine for treating laundry comprising a tub, the tub comprising a discharge hole for draining liquid out of the tub, and a plurality of drain-connection elements The laundry machine further comprises a discharge duct fluidly connected to the discharge hole for collecting liquid drained from the tub, and fixed to the tub by at least one of the drain-connection elements. The plurality of drain-connection elements comprises at least two different types of drain-connection elements, each one adapted for fixing a corresponding type of discharge duct to the tub by means of a corresponding connection arrangement.

In an advantageous embodiment of the invention, the tub further comprises a front half-shell and a rear half-shell. The discharge hole is provided on the front half-shell, on the rear half shell, or partly on the front half-shell and partly on the rear half-shell.

Preferably, the at least one type of the at least two different types of drain-connection elements comprises one or more drain-connection elements protruding from the tub, and the discharge duct further comprises one or more matching portions matching a corresponding one of the one or more drain-connection elements protruding from the tub.

In an advantageous embodiment, at least one of the one or more drain-connection elements protruding from the tub is fixed to a corresponding matching portion of the discharge duct by a fastening element.

In a preferred embodiment at least one drain-connection element of the one or more drain-connection elements protruding from the tub and a corresponding matching portion of the discharge duct are transversal with respect to other drain-connection elements and other matching portions, respectively.

Preferably, at least one of the one or more drain-connection element protruding from the tub comprises a hollow appendage adapted to engage with the at least one respective fastening element.

More preferably, at least one matching portion of the one or more matching portions comprises a through-hole adapted to the insertion of the at least one respective fastening element.

Advantageously, the laundry machine further comprises a drain collar protruding outwardly from the tub at a periphery of the discharge hole.

Preferably, the discharge duct comprises a wall adapted to encircle or to be encircled by a predetermined portion of the drain collar.

Advantageously at least one drain-connection element of the at least two different types of drain-connection elements is provided on the drain collar.

Preferably, the at least one drain-connection element provided on the drain collar comprises a threaded portion or bayonet elements provided on the drain collar and adapted to engage with a complementary threaded portion or bayonet element provided on the discharge duct.

In an advantageous embodiment, at least one drain-connection element provided on the drain collar comprises a sacrificial part provided on the drain collar and adapted to be used for welding the discharge duct to the tub.

Preferably, on an external side of the wall of the discharge duct at least a seat adapted to house at least one clamp member is provided, and the clamp member is adapted to tighten the wall against the at least one drain-connection element provided on the drain collar.

In an advantageous embodiment, the discharge duct is made of a hard polymer.

In a different advantageous embodiment the discharge duct is made of an elastomeric material.

These and others features and advantages of the solution according to the present invention will be better understood by reading the following detailed description of some embodiments thereof, provided merely by way of exemplary and non-limitative examples, to be read in conjunction with the attached drawings, wherein:

DETAILED DESCRIPTION OF EXAMPLE EMBODIMENTS

Figure 1:
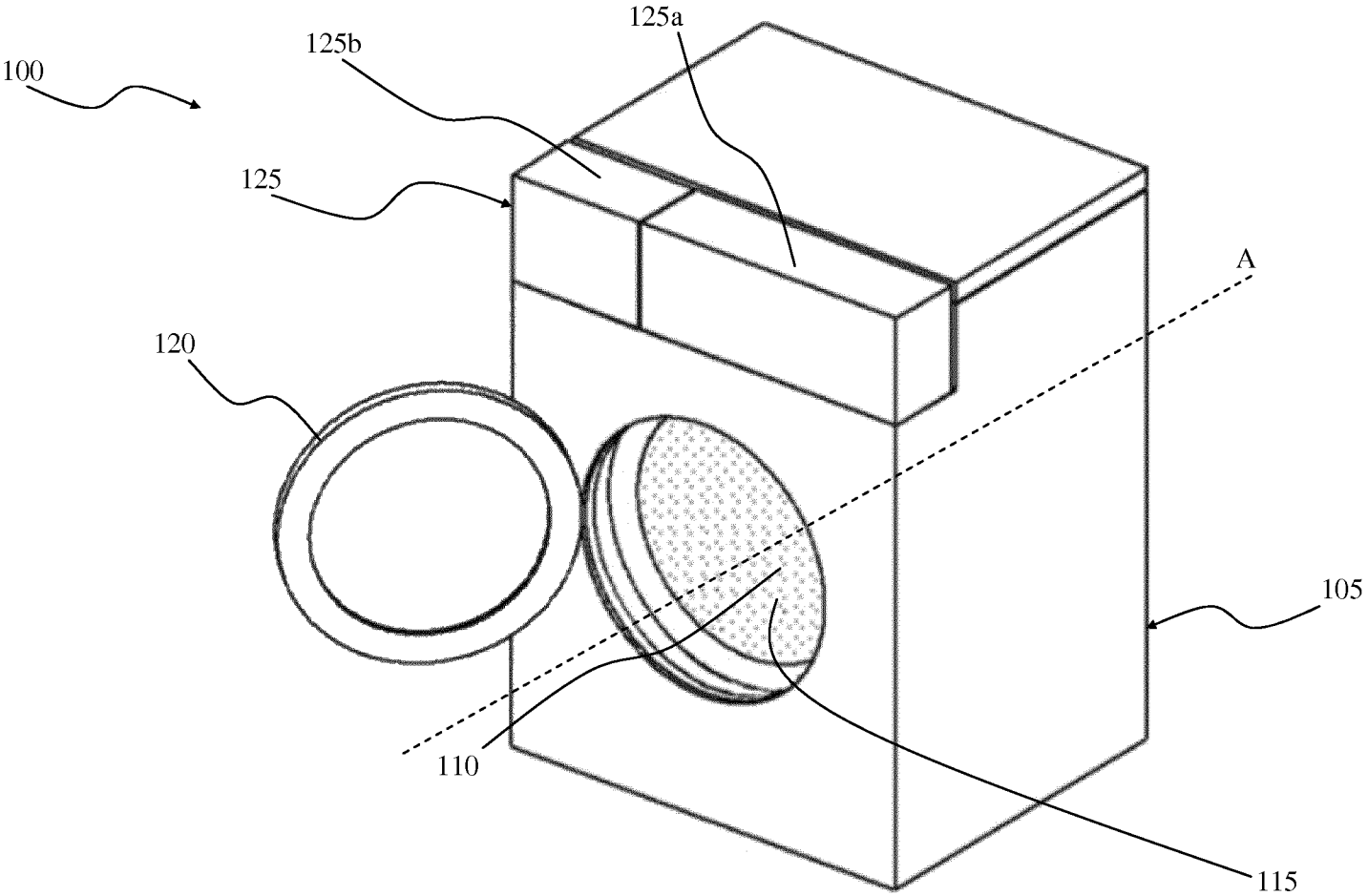
FIG. 1 is an isometric view of a laundry machine in which embodiments of the present invention may be implemented.

With reference to the drawings, FIG. 1 is an isometric view of a laundry machine 100 in which the present invention may be implemented.

The laundry machine 100 is a machine for treating laundry (such as a laundry washing machine, a laundry washing/drying machine, etc.) of the frontloading type. Anyway, it should be apparent from the following description that laundry machines of the top-loading type may also benefit from the solution according to the present invention.

In the example at issue, the laundry machine 100 comprises a preferably substantially parallelepiped-shaped casing or cabinet 105 that encloses a washing tub, or simply a tub 200 that is preferably substantially cylindrically-shaped (which is visible in FIG. 2), wherein the laundry is treated, along with any other component of the 10 laundry machine 100 necessary for its operation (e.g., hydraulic, electronic and electromechanical apparatuses known in the art and, therefore not herein described for sake of conciseness).

Particularly, the tub 200 houses a rotatable drum 110 preferably substantially cylindrical-shaped, which, in operation, rotates about an axis A in order to tumble the laundry to be washed.

In the example of FIG. 1, in order to allow a user to access the tub 200 and the inside of the drum 110 (for loading/unloading the laundry), a loading/unloading opening 115 is advantageously provided on a front side of the laundry machine 100. The loading/unloading opening 115 is closable by a door 120, which is, preferably, hinged to the casing 105 by means of a hinge (not shown in the figure). The door 120 is adapted to pivot from a closed position—wherein the door 120 closes the loading/unloading opening 115, impeding access to the drum 110—to an open position—wherein the door 120 is pivoted to an angle, preferably, equal to, or greater than, 90° with respect to the closed position—allowing access to the drum 110.

In addition, preferably, although not limitatively, on a top portion of the casing 105 a user interface 125 is provided. Preferably, although not limitatively, the user interface 125 may comprise a control panel 125*a* for selecting laundry treatment parameters (e.g., type of washing/drying cycle, washing liquid temperature, rotation speed for the drum 110, etc.) and a drawer 125*b* for loading laundry-treating products (e.g., detergents, softeners, bleachers, etc.).

Figure 2A:
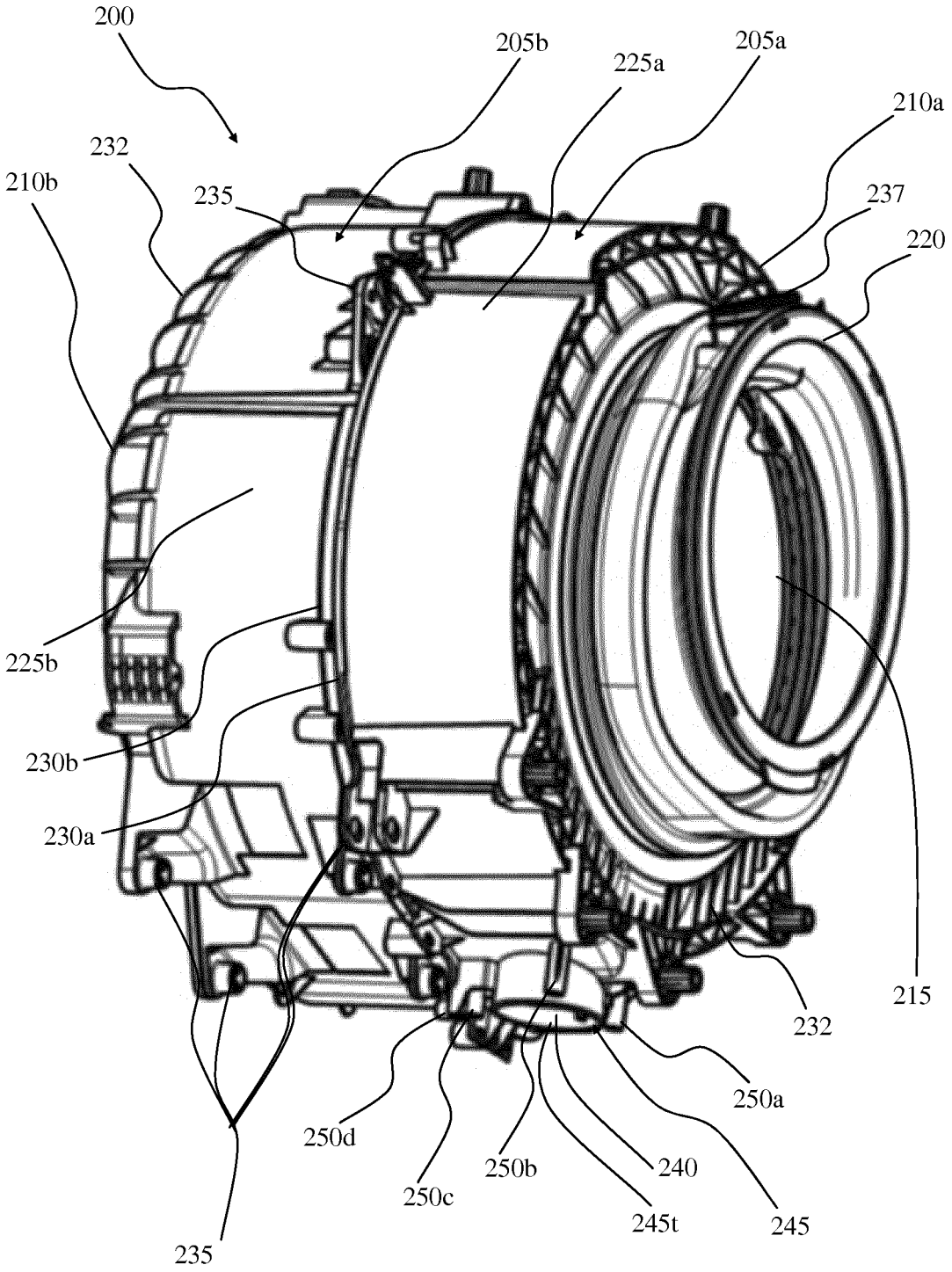
FIG. 2A is an isometric view of a tub of the laundry machine of FIG. 1 according to an embodiment of the present invention.
Figure 2B:
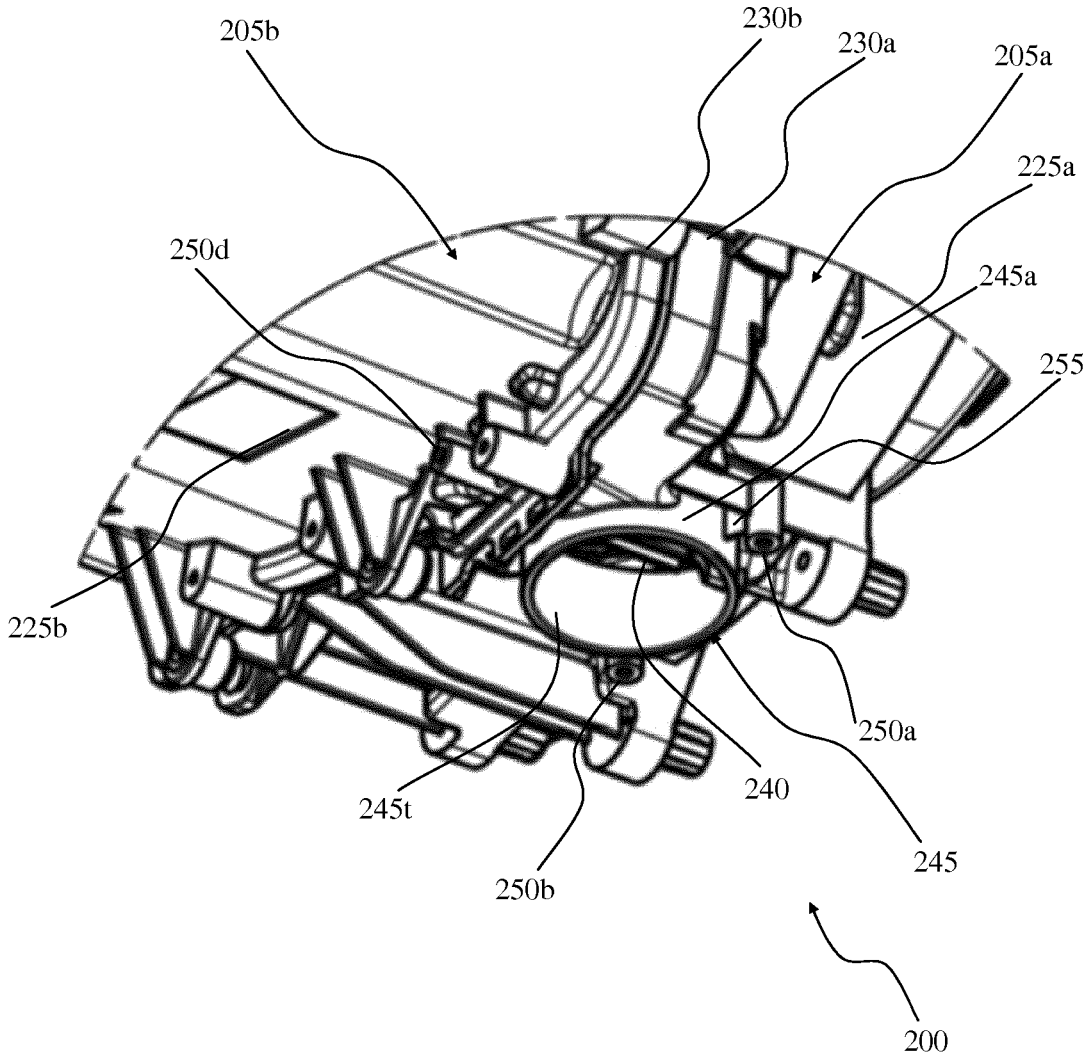
FIG. 2B is an enlarged view of a lower part of the tub of FIG. 2A according to an embodiment of the present invention.

Turning now to FIGS. 2A and 2B, there is shown an isometric view of the tub 200 of the laundry machine 100 and an enlarged view of a lower part of the tub 200, respectively, according to an embodiment of the present invention.

The tub 200 has preferably a substantially cylindrical shape and is made of waterproof material which is also able to withstand operating temperatures and chemicals reactions promoted by washing liquid during the laundry machine operation. For example, the tub 200 may be made of a suitable plastic polymer, such as calcium carbonate-filled polypropylene.

Advantageously, although not limitatively, the tub 200 comprises a front half-shell 205*a* and a rear half-shell 205*b*, each having substantially the shape of an hollow cylinder.

In the example at issue, the front half-shell 205*a* comprises a foreside 210*a*, which substantially has a discoid shape. Advantageously, the foreside 210*a* is provided with a front opening 215, which is adapted to be aligned with the loading/unloading opening 115 provided in the casing 105, and with a corresponding opening of the drum 110 (once the tub 200 is positioned inside the casing 105). Moreover, in order to achieve a watertight connection between the loading/unloading opening 115 and the front opening 215 (in order to avoid leakages of washing liquid into the casing 105), a bellows 220, preferably made of an elastomeric and waterproof material, is mounted in a watertight manner (such as by glueing, by welding, by interference fitting etc.) to both a border of the tub front opening 215 and a border of the loading/unloading opening 115.

The front half-shell 205*a* comprises a front cylindrical sidewall 225*a*, which extends substantially transversal from an outer periphery of the foreside 210*a*. Advantageously, the front sidewall 225*a* ends with a front half-shell border or flange 230*a*, which is adapted to match a corresponding, rear half-shell border or flange 230*b* of the rear half-shell 205*b*.

The rear half-shell 205*b* comprises a backside or backwall 210*b*, which also substantially has a discoid shape. Advantageously, the backside 210*b* is provided 30 with a shaft opening (not shown). In such a shaft opening advantageously is inserted a rotor shaft (not shown) attached to the drum 110 and rotatably connected (directly or by means of transmission elements such as a transmission belt) to an electric motor (also not shown) included in the laundry machine 100 in order to rotate the drum 130 during operation.

The rear half-shell 205*b* comprises a rear cylindrical sidewall 225*b* that extends substantially transversal from an outer periphery of the backside 210*b*. The rear sidewall 225*b* ends with the rear half-shell border 230*b*, which matches with the front half-shell border 230*a* of the front half-shell 205*b*.

The foreside 210*a*, the backside 210*b*, and the two cylindrical sidewalls 225*a* and 225*b* may advantageously be provided with ribs 232 adapted to increase structural strength of the half-shells 205*a* and 205*b*. The foreside 210*a*, the backside 210*b*, and the two sidewalls 225*a* and 225*b* are preferably provided with fastening elements 235 protruding externally therefrom. For example, the fastening elements 235 may comprise treaded slots for screws or bolts and/or anchoring protrusions typically adapted to connect the tub 200 with a number of coil springs and/or shock-absorbers (not shown in the figures) through which the tub 200 is suspended in floating manner inside the casing 105.

A washing liquid inlet port 237 is advantageously provided in a top portion of the bellows 220 (alternatively a different inlet port may be provided in tub 200) and is fluidly connected to an inlet hydraulic system (not shown in the figures) in order to supply washing liquid in the tub 200 during the laundry machine 100 operation.

In the example at issue, a discharge hole 240 is advantageously provided at the bottom of the tub 200, for example in a lower portion of the front sidewall 225*a*; the discharge hole 240 serves as outlet for waste liquid. Anyway, it should be noted that the discharge hole 240 could be provided in the rear half-shell 205*b* as well, or even the discharge hole 240 could be split between the two half-shells 205*a* and 205*b* (thus being provided partly along each one of the borders 230*a* and 230*b*); in general, the discharge hole 240 may be provided where it results to be more useful (i.e., according to the position of other component parts inside the casing 105).

Advantageously, the discharge hole 240 is preferably surrounded by a cylindrical wall, forming a discharge hole collar or drain collar 245, which protrudes, outwards from the tub 200 at a periphery of the discharge hole 240, and has a free end that delimits a collar bottom aperture 245*t* (i.e., opposite to the discharge hole 240 in the front sidewall 225*a*).

In the solution according to an embodiment of the present invention, the drain collar 245 is provided with a plurality of drain-connection elements adapted to the connection to the tub 200 of a discharge duct 300, 500 or 600 (shown in FIGS. 3, 5A and 6A, respectively) in a variety of manners. The plurality of drain-connection elements comprises different connection elements adapted to connect together the drain collar 245 and the discharge duct 300, 500 or 600 for collecting the waste liquid; different types of connections are supported, each of which depends on a type of the discharge duct 300, 500 or 600 used (as will be described in the following). For example, the drain collar 245 may be provided at once with any combination of sets of receptacles for screws and/or bolts, bayonet mounting elements, threaded portions, snap-fitting members, sacrificial parts (e.g., for welding of the discharge duct 300 or 500), etc.

In the example at issue, as best shown in FIGS. 2A and 2B, drain-connection elements comprise a number of hollow appendages preferably internally threaded or adapted to be threaded by a self-threading screw, such as three hollow appendages 250*a*, 250*b* and 250*c* that protrude from the tub 200 around the drain collar 245, and a fourth hollow appendage 250*d*, preferably internally threaded or adapted to be threaded by a self threading screw, that is provided in the proximity of the drain collar 245, and is formed with an axis that is transversal, preferably orthogonal, with respect to the axis of the hollow appendages 250*a*, 250*b* and 250*c*. As shown in the figures, the hollow appendages 250*a*, 250*b*, 250*c* and 250*d* have substantially the shape of a hollow cylinder, but other shapes, such as hollow prisms or a hollow frustoconical shapes, are not excluded.

At least one hollow appendage 250*a*, 250*b*, 250*c* and 250*d* is advantageously designed for engaging with a threaded fastening element. For example, at least one hollow appendage 250*a*, 250*b*, 250*c* and 250*d* may serve as female receptacle for screws or bolts. Alternatively or in addition, at least one hollow appendage 250*a*, 250*b*, 250*c* and 250*d* may be provided with hooking elements (such as properly shaped slots) adapted to engage corresponding snap-fitting members (such as lugs) provided on the discharge duct 300, 500 or 600. As an alternative, the hollow appendages 250*a*, 250*b*, 250*c* and 250*d* may be adapted to engage different fastening elements; for example, the hollow appendages 250*a* and 250*d* may be adapted to serve as female receptacle for screws while the hollow appendages 250*b* and 250*d* may be adapted to engage corresponding snap-fitting members.

Advantageously, although not limitatively, the three hollow appendages 250*a*, 250*b* and 250*c* are spaced apart from the drain collar 245, being connected thereto through a respective reinforcement and connection element, such as connection rib 255. In this way, a collar band 245*a* of the drain collar 245 ranging from its free end (i.e., in correspondence of the collar bottom aperture 245*t*) to the connection ribs 255 remains advantageously clear and easily reachable; thus, such collar band 245*a* may be used as(for) further drain-connection element for achieving a coupling between the drain collar 245 and the discharge duct 300, 500 or 600 (as will be discussed in detail later on). Alternatively, one or more (up to all) of the hollow appendages 250*a*, 250*b* and 250*c* may be formed adjacent (i.e., in contact with) the drain collar 245 (and possibly formed integral therewith) or completely separated therefrom.

Advantageously, although not limitatively, one or more hollow appendage 250*a*, 250*b*, 250*c* and 250*d* may be provided formed in the half-shell 205*b* or 205*a* opposite to the half-shell 205*a* or 205*b* in which the drain collar 245 is provided. In the example at issue, the fourth hollow appendage 250*d* may be provided on the rear half-shell 205*b* at the rear border 230*b* thereof in a position proximal to the drain collar 245 once the two half-shells 205*a* and 205*b* are associated together. In the case where the drain collar 245 is formed partly in the front half-shell 205*a* and partly in the rear half-shell 205*b*, hollow appendages 250*a*, 250*b*, 250*c* and 250*d* may be formed in both the half-shells 205*a* and 205*b*.

During a manufacturing phase of the laundry machine 100, the two half-shells 205*a* and 205*b* are joined together, with the drum 130 enclosed therein, by matching and coupling the corresponding borders 230*a* and 230*b* in any suitable manner (e.g., by welding); in this way, the tub 200 rotatably houses the drum 130.

Figure 3:
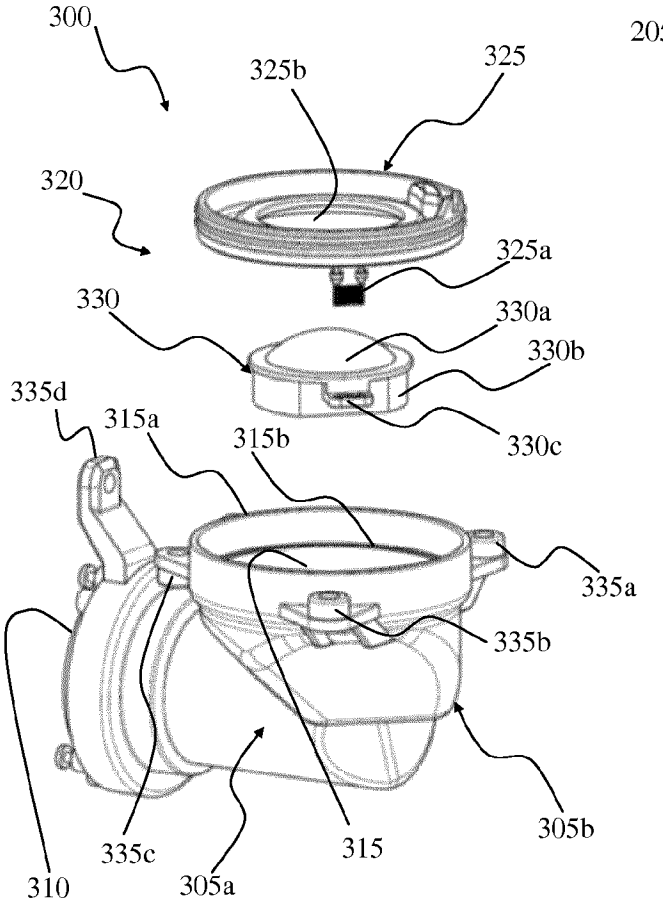
FIG. 3 is an exploded view of a manifold made of hard material according to an embodiment of the present invention.

Considering now FIG. 3, it is an exploded view of a drain discharge duct or manifold 300 made of hard material according to an embodiment of the present invention.

The manifold 300 is made of hard material such as a suitable plastic polymer (e.g., again calcium carbonate-filled polypropylene) and comprises a first hollow portion 305*a* preferably formed with a substantially cylindrical shape, and a second hollow portion 305*b* preferably having a substantially frustoconical shape (although further portions or alternative portions featuring other shapes are not excluded). The second hollow portion 305*b* is fluidly connected, through its smallest base, substantially transversal to the first hollow portion 305*a* at an end thereof. Both the first hollow portion 305*a* and the second hollow portion 305*b* may be formed in a single piece (e.g., may be produced in a single cast) or the manifold 300 may be formed by an interconnection of separated first hollow portion 305*a* and second hollow portion 305*b*.

At an opposite free end of the first hollow portion 305*a* a preferably circular drain-side aperture 310 is provided, which is adapted to engage a pump assembly (not shown in the figures) for draining waste liquid from the manifold 300 and, possibly, the tub 200 of the laundry machine 100.

At a free end of the second hollow portion 305*b*, a preferably circular tub-side aperture 315 is provided. Advantageously, the tub-side aperture 315 may comprise a tub-side wall 315*a* and a holding rib 315*b*, which may be adapted to encompass and hold, respectively, a valve member 320 that may be provided for separating the cool waste liquid collected in the manifold 300 from the warm washing liquid contained in the tub 200 during the laundry machine 100 operation.

The valve member 320 may comprise a substantially ring-shaped sealing gasket 325 and a buoyant element such as a cap 330.

Advantageously, although not limitatively, such sealing gasket 325 is made of a resilient material and designed to fit, in a watertight manner, the space defined by the tub-side wall 315*a* and the tub-side holding rib 315*b* (to which the sealing gasket 325 may possibly be glued or attached in any other suitable way). The sealing gasket 325 comprises a tab 325*a* protruding downwards (i.e., towards the inside of the second hollow portion 305*b* when the valve member 320 is mounted in the manifold 300) from a lower portion of the sealing gasket 325. The sealing gasket 325 comprises a substantially circular gasket aperture 325*b* adapted to be watertight closed by the cap 330.

In the example at issue, the cap 330 is preferably, but not limitatively, made of hard material (such as a plastic polymer). The cap 330 is preferably substantially cylindrically shaped with a substantially hemispherical top 330*a*, which is encircled by a flat abutment border 330*b*. The abutment border 330*b* is adapted to abut a lower rim of the gasket aperture 320*b* achieving the watertight closure of the tub-side aperture 315.

The cap 330 preferably comprises an eyelet 330*c* protruding laterally from the cap 330, for example at mid-height of a side of the cap 330. The tab 325*a* of the sealing gasket 325 is adapted to be inserted into the eyelet 330*c*, thus allowing the cap 330 to pivot about the tab 325*a*, during operation, from a closed position, in which the abutment border 330*b* abuts the gasket aperture 320*b*, to an open position, in which the cap 330 is substantially transversal to the gasket aperture 320*b*.

Anyway, it should be noted that embodiments according to the present invention may be implemented in laundry machines exploiting types of valve member other than the one herein described or, ultimately, implementing a discharge duct 300, 500 or 600 lacking of such valve member.

In the solution according to an embodiment of the present invention, the manifold 300 further comprises a plurality of matching portions, such as wings formed along the tub-side wall 315*a* and protruding therefrom, each advantageously having a trough-hole; in the example at issue, three matching portions or wings 335*a*, 335*b* and 335*c* are provided. In addition, along the periphery of the drain-side aperture 310 a further matching portion or wing 335*d* is provided. It should be noted that, since the drain-side aperture 310 is transversal to the tub-side aperture 315, the wing 335*d* has an axis that is transversal, preferably orthogonal, with respect to the ones of the wings 335*a*, 335*b* and 335*c*.

In alternative embodiments according to the present invention the matching portion may be formed on a border of the tub-side aperture, instead protruding from its wall.

Figure 4A:
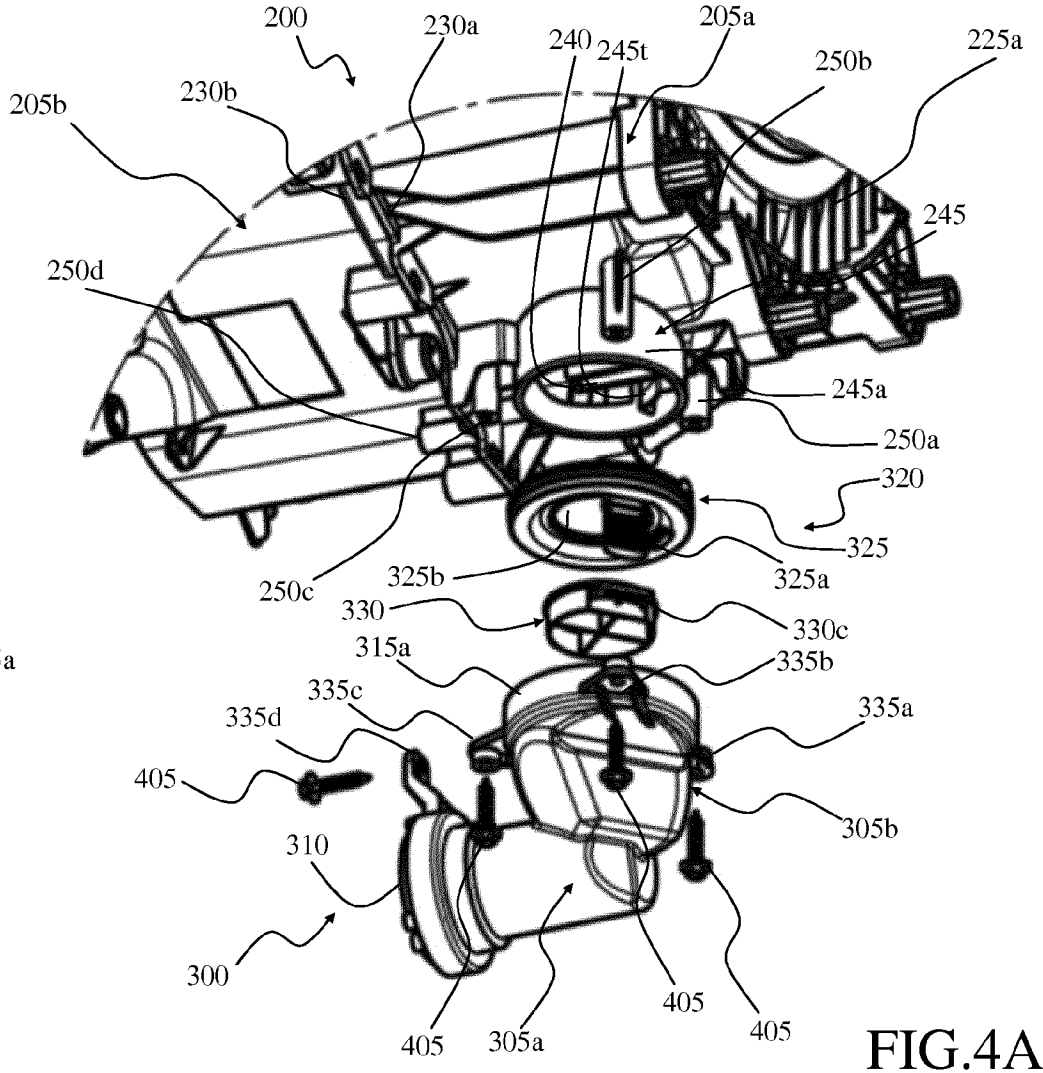
FIG. 4A shows the manifold of FIG. 3 while being mounted to the tub of FIG. 2A.
Figure 4B:
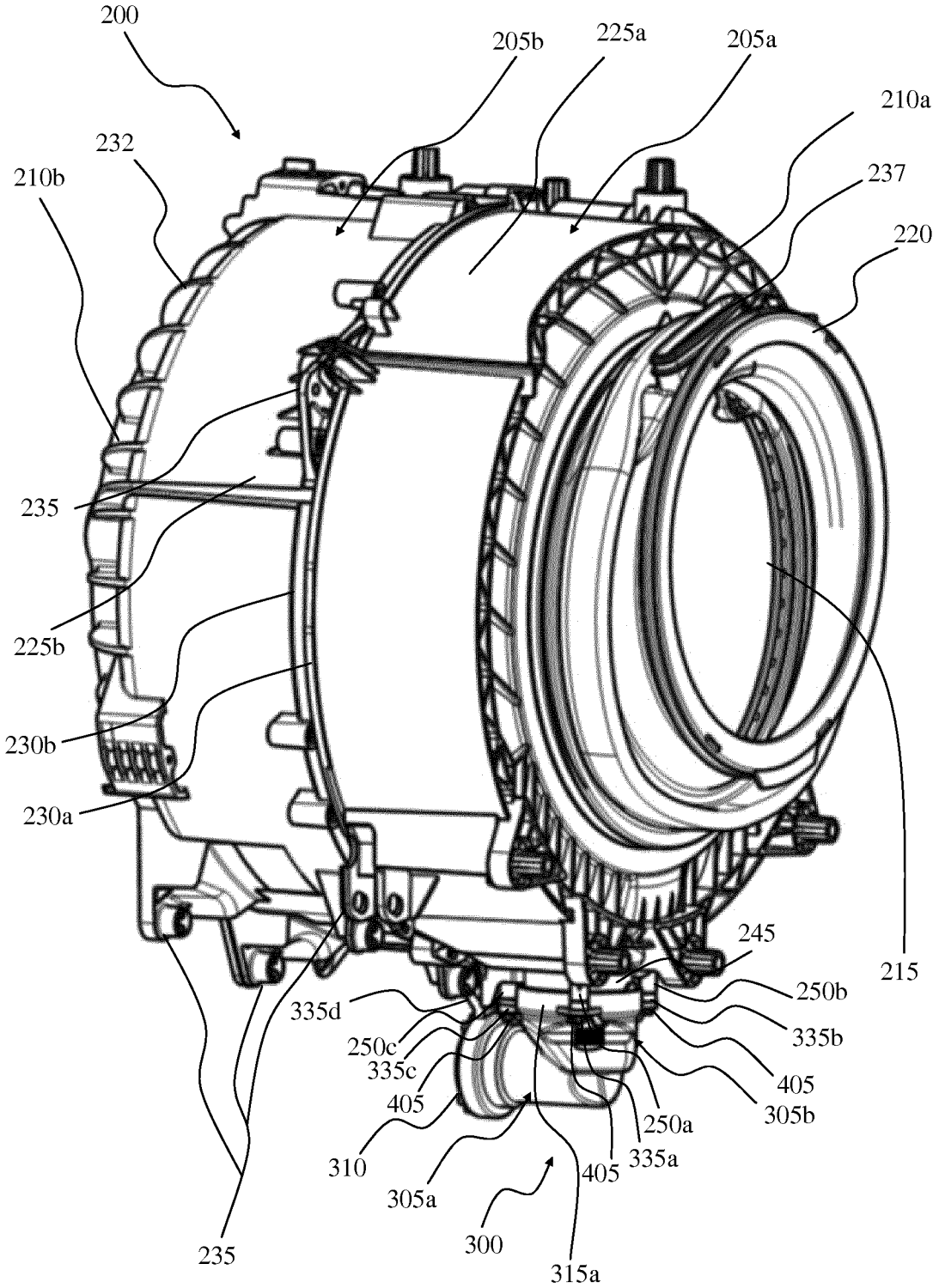
FIG. 4B shows the manifold of FIG. 3 mounted to the tub of FIG. 2A.

Turning jointly to FIGS. 4A and 4B, which show the manifold 300 while being mounted to the tub 200 and the manifold 300 mounted to the tub 200, respectively, the mounting of the manifold 300 to the tub 200 is now described.

In the example at issue, the drain collar 245 is inserted into the tub-side aperture 315, since the former has a diameter smaller than the diameter of the latter (although other embodiments in which the drain collar 245 has a diameter larger than, or substantially equal to, the tub-side aperture 315 are not excluded). Advantageously, the drain collar 245 is inserted into the tub-side aperture 315 until the free end of the drain collar 245 abuts an upper portion of the sealing gasket 325.

In the solution according to an embodiment of the present invention, advantageously, preferably each matching portion or wing 335*a*, 335*b*, 335*c* and 335*d* of the manifold 300 is designed to match a corresponding drain-connection element provided on the tub 200, such as the corresponding hollow appendage 250*a*, 250*b*, 250*c* and 250*d*, as the drain collar 245 is inserted into the tub-side aperture 315.

Alternatively, the wings 335*a*, 335*b*, 335*c* and 335*d* on the manifold 300 may be in a different number with respect to the hollow appendages 250*a*, 250*b*, 250*c* and 250*d* provided on the tub 200—in order to be adapted to the connection with other tubs (not shown) having a different number or disposition of hollow appendages—, in which case only part of the wings 335*a*, 335*b*, 335*c* and 335*d* matches corresponding hollow appendages 250*a*, 250*b*, 250*c* and 250*d*.

Subsequently, suitable fastening elements, such as screws 405, may be inserted, each one into the through hole of the corresponding wings 335*a*, 335*b*, 335*c* and 335*d* and engaged with the corresponding hollow appendage 250*a*, 250*b*, 250*c* and 250*d*, once the manifold 300 is coupled to the drain collar 245. In some embodiments according to the present invention, only a part of the hollow appendages 250*a*, 250*b*, 250*c* and 250*d* may be engaged with screws 405 while the remaining part of the hollow appendages 250*a*, 250*b*, 250*c* and 250*d* may be left unengaged. For example, the tub 200 may be connected to a tub (not shown) having a lower number of matching portions than the hollow appendages 250*a*, 250*b*, 250*c* and 250*d* provided on the tub 200.

The matching pair of wing 335*d*—internally-threaded hollow appendage 250*d*, which is transversal, preferably orthogonal, with respect to the other pairs of wings 335*a*, 335*b* and 335*c*—hollow appendages 250*a*, 250*b* and 250*c* ensures a greater robustness in the coupling between the manifold 300 and the drain collar 245 than having all the pairs parallel one to another, since the fastening elements provided (e.g., the screws 405) act in two distinct fastening directions.

Once the screws 405 have been fastened, the manifold 300 results firmly connected to the drain collar 245 and thus to the whole tub 200. Thanks to the tightening strength provided by the fastened screws 405, the free end of the drain collar 245 advantageously abuts an upper portion of the sealing gasket 325 in a watertight manner, thus ensuring a leakage-less fluid communication between the manifold 300 and the tub 200. Preferably, the drain-side aperture 310 may be fluidly connected to a pump assembly (not shown in the figures) an outlet of which is fluidly connected to a discharge hose for disposing the waste liquid in a house draining pipe system.

The laundry machine 100 may advantageously comprise a recirculation system (not shown in the figures) adapted to reuse part of drained waste liquid, during the laundry machine 100 operation in order to reduce liquid consumption (particularly, water consumption). In this case, a recirculation duct may be selectively connected to the filter-pump assembly outlet (for example, in parallel with the draining hose) for receiving part of the waste liquid to be fed to the recirculation system.

In addition or in alternative, embodiments according to the present invention may be provided with various drain-connection elements. For example, an external face of the collar band 245*a* (or a portion thereof) may be threaded so as to match a complementary engagement thread advantageously provided on an internal face of the tub-side wall 315*a*. Thanks, to the matching threads it is possible to screw the manifold 300 to the drain collar 245 until a watertight engagement between the two is reached.

In other embodiments according to the present invention, for attaining the watertight connection between the manifold 300 and the drain collar 245, bayonet mounting elements may be provided as drain-connection elements. For example, on the collar band 245*a* male bayonet elements, such as one or more radially-protruding pins, may be provided, while complementary female bayonet elements, such as substantially L-shaped slots, may be provided in the tub-side wall 315*a*. Thus, by engaging male bayonet components with the complementary female bayonet components a watertight connection between manifold 300 and the tub 200 is achieved.

In embodiments according to the present invention, a sacrificial part may be provided as drain-connection element. Preferably, the sacrificial part is formed in correspondence of at least one free end of the drain collar 245 of the tub 200 (and possibly a corresponding sacrificial part may be provided on the tub-side wall 315*a* of the manifold 300). For example, the sacrificial part may be advantageously made integral with the drain collar 245 (and possibly the tub-side wall 315*a*) on which is provided (i.e., the sacrificial part is made of the same material and with the same plastic cast). Advantageously, the sacrificial part allows connecting the manifold 300 to the tub 200 by welding. In other words, sacrificial parts are adapted to melt when the manifold 300 is welded to the tub 200 during the manufacturing phase of the laundry machine 100. For example, in the case of vibration welding, the free ends of the drain collar 245 and the tub-side wall 315*a* the are brought in contact and then a vibrating force and a compressive force are applied to the manifold 300 and/or to the tub 200 with an intensity strong enough to melt the sacrificial part, which after hardening connects in a watertight manner the manifold 300 and the tub 200.

It should be noted that the sacrificial part may be advantageously threaded; in such a way, the manifold 300 could be connected to the tub 200 either by welding or by screwing.

Figure 5A:
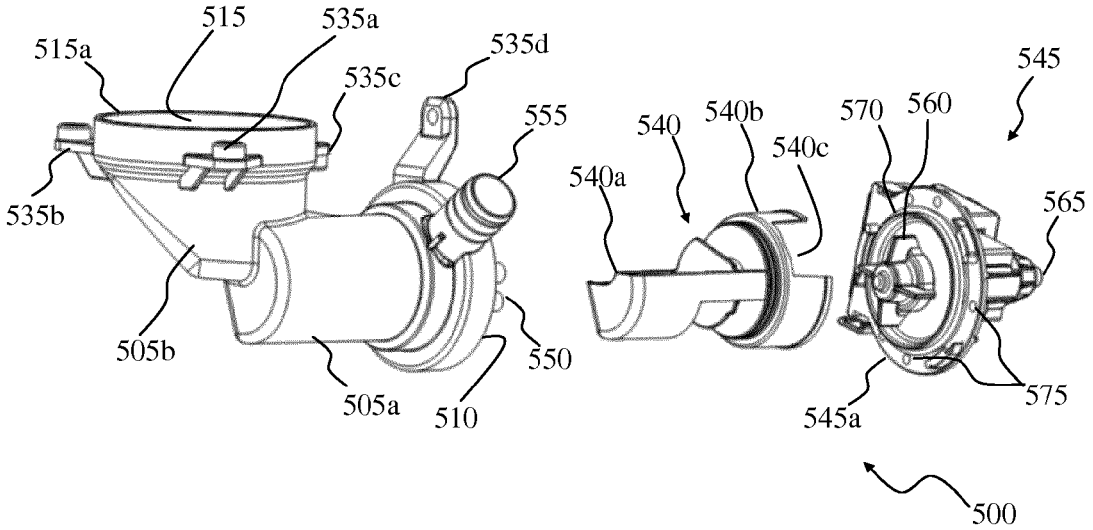
FIG. 5A shows another manifold of hard material according to an embodiment of the present invention.
Figure 5B:
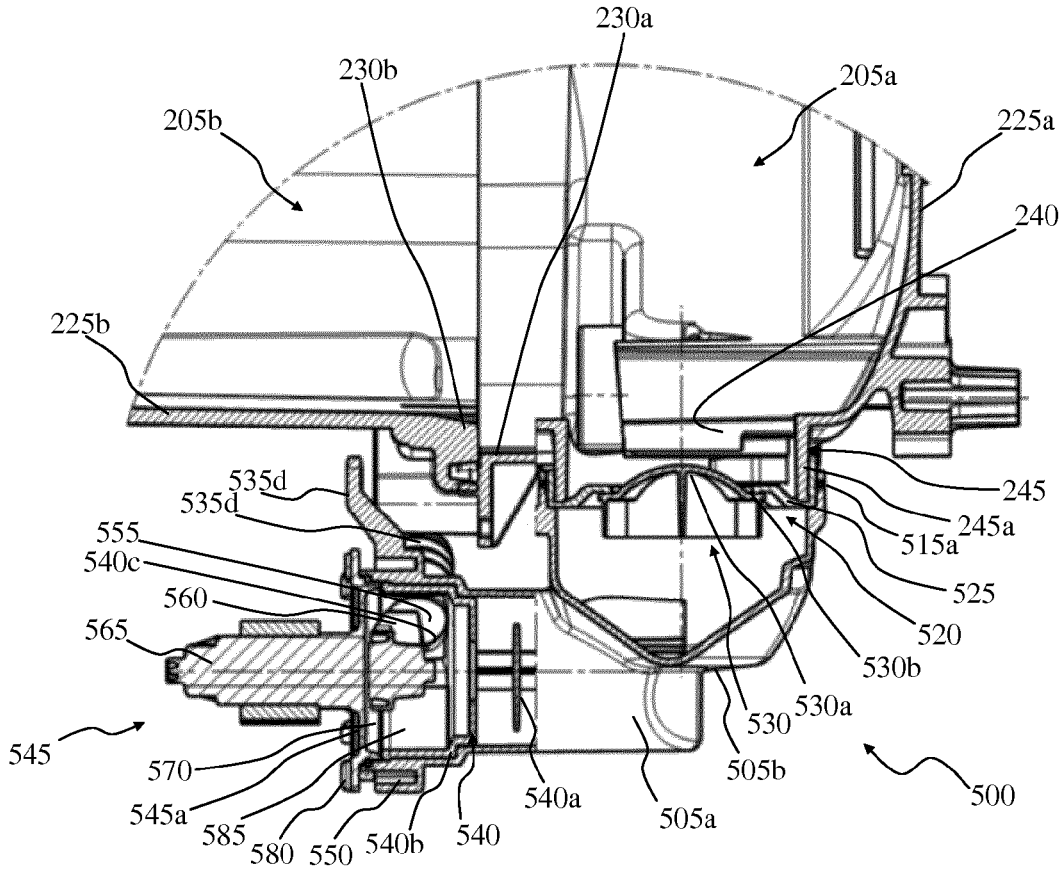
FIG. 5B is a partial cross-sectional and enlarged view of the manifold of FIG. 5A associated with the tub of FIG. 2A.

Turning now jointly to FIGS. 5A and 5B, they show another manifold 500 of hard material according to the present invention and such manifold 500 mounted to the tub 200, respectively.

The manifold 500 differs from the manifold 300 made of hard material previously described in what follows.

The manifold 500 comprises a filter 540, a drain pump 545 and a set of pump connection elements 550 provided along the border of drain-side aperture 510. In addition, substantially at the drain-side aperture 510, an exhaust port 555 is provided, preferably, laterally on the manifold 500.

Advantageously, the filter 540 is adapted to be housed within the first hollow portion 505*a* of the manifold 500. The filter 540 is adapted to prevent fluff and/or small foreign bodies incoming from the tub 200 (not shown, for example buttons detached from laundry being washed, small coins etc.) reaching the drain pump 545 positioned downstream (which may experience malfunctions due to such fluff and/or foreign bodies) and/or remaining inside the draining system (which may lead to a clogging of the draining system). A filter front portion 540*a* has a shape designed for blocking said fluff and/or foreign bodies. A rear filter portion 540*b* is fluidly connected with the filter front portion 540*a* and preferably, although not necessarily, formed integral with the same. Such rear filter portion 540*b* is preferably substantially a hollow half-cylinder having a filter port 540*c*.

The drain pump 545 preferably comprises an impeller 560 and an actuator 565 (e.g., an electric motor), which is adapted to rotate the impeller 560. The impeller 560 is exposed on a contact wall 545*a* of the drain pump 545 on which may be preferably provided a circular pump-sealing gasket 570 and a set of through holes 575.

During a manufacturing phase, the filter 540 is inserted in the first hollow portion 505*b* with the filter front portion 540*a* that substantially tightly fits the same, while the rear filter portion 540*b* tightly fits the tub-side aperture 515, and the filter port 540*c* is aligned with the exhaust port 555.

Subsequently, the drain pump 545 is coupled with the drain-side aperture 510 and then fastened thereto. In the example at issues, each through hole 575 on the contact wall 545*a* matches a corresponding pump connection element 550 (such as a threaded cavity), and the drain pump 545 is fastened to the first hollow portion 505*b* by means pump fastening elements, such as pump screws 580, each of which is inserted into the respective through hole 575 and screwed to the corresponding pump connection element 550.

Therefore, the contact wall 545*a* of the drain pump 545 closes the drain-side aperture 510 of the manifold 500. The contact wall 545*a* and the rear filter portion 540*b* result watertight connected, and thanks to the pump-sealing gasket 570, define a watertight impeller chamber 585 housing the impeller 560 of the drain pump 545.

Finally, a drain hose (not shown in the figures) is connected to the exhaust port 555 (in any known manner) for the connection with the rest of the draining system.

In operation, waste liquid drained from the tub 200 is collected in the second hollow portion 505*a* of the manifold 500, filtered by the filter 540 and passed in the impeller chamber 585. Hence, the waste liquid is propelled by the impeller 560 into the exhaust port 555 and therefrom into the drain hose for being discharged or re-circulated.

It should be noted that also the manifold 500 may be adapted to be connected to the tub 200 with any of the various drain-connection elements previously described with reference to the manifold 300.

Figure 6A:
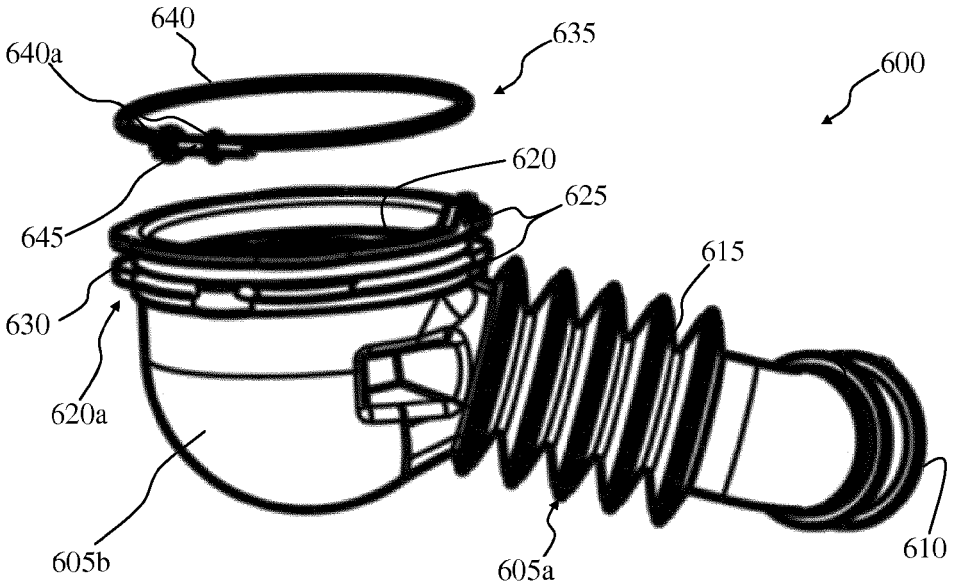
FIG. 6A shows a flexible hose according to an embodiment of the present invention.
Figure 6B:
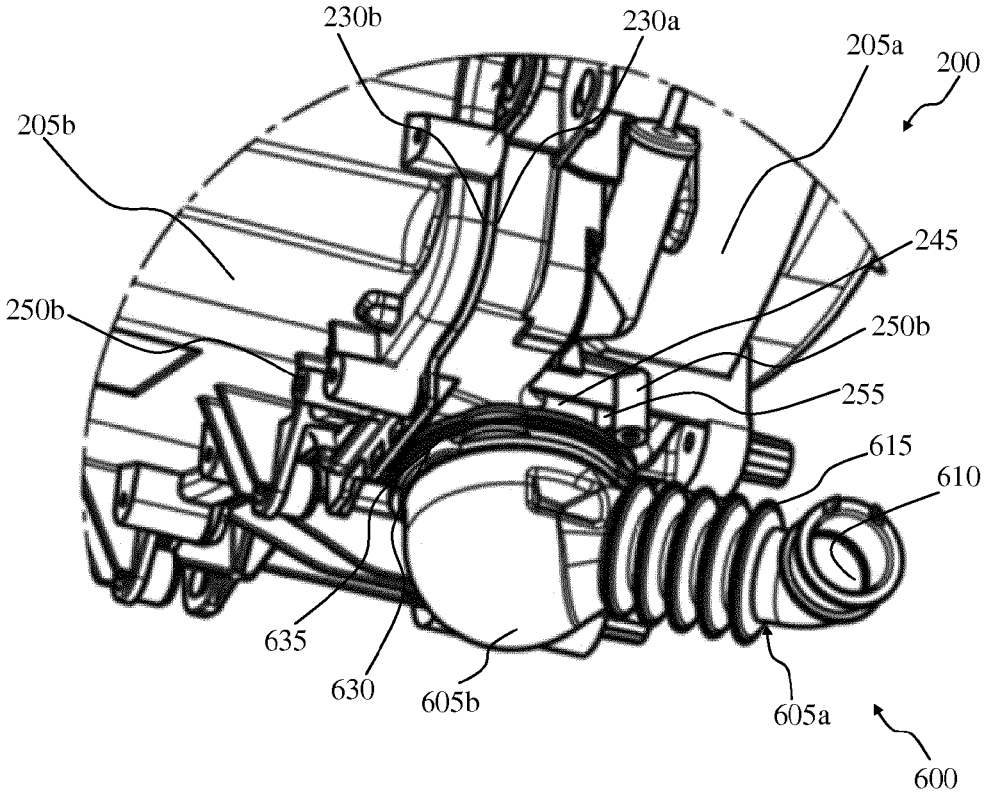
FIG. 6B show the flexible hose of FIG. 6A mounted to the tub of FIG. 2A.

Considering jointly FIGS. 6A and 6B, they show another typology of discharge duct, a flexible hose 600 and such flexible hose 600 mounted to the tub 200, respectively.

In detail, the flexible hose 600 is made of an elastomeric material (such as a synthetic rubber), which comprises a hose portion 605*a* and a main hollow portion 605*b* preferably having a substantially hemispherical shape, fluidly connected one another.

The hose portion 605*a* preferably protrudes substantially laterally from the hemispherical portion 605*b*. Both the main portion 605*b* and the hose portion 605*a* may be formed in a single piece (e.g., may be produced in a single cast) or the flexible hose 600 may be formed by a connection of a distinct main portion 605*b* and hose portion 605*a*.

A circular drain-side aperture 610 is provided at a free end of the hose portion 605*a*, which is adapted to be engaged with the pump assembly (not shown).

Advantageously, although not limitatively, the hose portion 605*a* may comprise a drain bellows 615 adapted to dampen vibrations induced by the suction action of a drain pump (not shown in the figures) possibly provided downstream the flexible hose 600 in the draining system and/or vibrations of the tub 200 induced by the rotation of the drum 110 during operation.

At a free end of the main portion 605*b*, a circular tub-side aperture 620 is provided. Preferably, although not limitatively, the tub-side aperture 620 comprises a tub-side wall 620*a* on an outer side of which one or more seat for housing a fastening element are provided. In the example at issue, couple of protruding ribs 625 define a track 630 adapted to house a clamp member 635 (as described in the following).

Advantageously, although not limitatively, the main portion 605*b* may be advantageously adapted to house a valve member (not shown in the figures) for separating the cool waste liquid collected in the flexible hose 600 from the warm washing liquid contained in the tub 200 during the laundry machine 100 operation, as previously stated.

In the example at issue, the drain collar 245 is inserted into the tub-side aperture 620, since the former has a diameter smaller than the diameter of the latter (although other embodiments in which the drain collar 245 has a diameter larger than, or substantially equal to, the tub-side aperture 620 are not excluded). Advantageously, the drain collar 245 is inserted into the tub-side aperture 620 until the free end of the drain collar 245 abuts an upper portion of the sealing gasket, and/or until the tub-side aperture 620 has completely surrounded the collar band 245*a*.

In order to fasten the flexible hose 600 to the tub 200 the clamp member 635 (e.g., a hose clamp) may be provided. In the example at issue, the clamp member 635 comprises an open-ring element 640 (e.g., such as a circular stripe made of metal or plastic) and a tightening element, such as a bolt 645. In its turn, the open-ring element 635*a* comprises engagement members 640*a* (such as a pair of small threaded rings) at each one of it ends to which the bolt 645 may be coupled. It should be noted that other clamp members, such as cable ties, may be used as well.

During the laundry machine 100 manufacturing phase, the clamp member 635 is placed around the tub-side wall 620*a*, preferably housed in one of the tracks 630 provided thereon. Then, the clamp member 635 is fastened against the tub-side wall 620*a* (while the latter encircles the collar band 245*a*) by screwing the bolt 645 to the engagement members 640*a*, which are thus brought close to each other. Once fastened, the tub-side wall 620*a* results firmly coupled with the drain collar 245 in watertight manner. In other words, the tub-side wall 620*a* is substantially caught in a vice-like grip between the collar band 245*a* and the fastened clamp member 635.

Thanks to the solution according to an embodiment of the present invention, it is thus possible to properly perform the connection between the same tub 200 and discharge ducts belonging to different types, such as the manifolds 300 and 500 or the flexible hose 600, even if the discharge ducts 300, 500 and 600 require different fastening elements and/or procedures. Consequently, also the manufacturing planning complexity is substantially lowered, since is no longer needed to match a particular discharge duct type with a corresponding tub type, thus improving the manufacturing yield while lowering the manufacturing costs.

The invention claimed is:

1. A laundry machine for treating laundry comprising a tub, said tub comprising:

a discharge hole for draining liquid out of the tub, a drain collar protruding outwardly from the tub at a periphery of the discharge hole;

a plurality of drain-connection elements comprising at least two different types of drain-connection elements, and a discharge duct having a connection arrangement fluidly connected to the discharge hole for collecting liquid drained from the tub, the discharge duct firmly fixed to said tub by at least one of said drain-connection elements, wherein each different drain-connection element is configured to fix a corresponding different type of connection arrangement of a discharge duct to said tub, wherein at least one type of said at least two different types of drain-connection elements comprises one or more drain-connection elements protruding from the tub; and wherein at least one type of said at least two different types of drain-connection elements is provided on the drain collar.

2. The laundry machine according to claim 1, wherein the connection arrangement further comprises one or more matching portions matching a corresponding one of said one or more drain-connection elements protruding from the tub.

3. The laundry machine according to claim 2, wherein the discharge duct is made of a hard polymer.

4. The laundry machine according to claim 2, wherein at least one of said one or more drain-connection elements protruding from the tub is fixed to a corresponding matching portions of said connection arrangement by a fastening element.

5. The laundry machine according to claim 4, wherein at least one drain-connection element of said one or more drain-connection elements protruding from the tub and a corresponding matching portion of said connection arrangement are transversal with respect to other drain-connection elements and other matching portions, respectively.

6. The laundry machine according to claim 2, wherein at least one drain-connection element of said one or more drain-connection elements protruding from the tub and a corresponding matching portion of said connection arrangement are transversal with respect to other drain-connection elements and other matching portions, respectively.

7. The laundry machine according to claim 6, wherein at least one of said one or more drain-connection element protruding from the tub comprises a hollow appendage configured to engage with the at least one respective fastening element.

8. The laundry machine according to claim 4, wherein at least one of said one or more drain-connection element protruding from the tub comprises a hollow appendage configured to engage with the at least one respective fastening element.

9. The laundry machine according to claim 8, wherein at least one matching portion of the one or more matching portions comprises a through-hole configured to the insertion of the at least one respective fastening element.

10. The laundry machine according to claim 1, wherein the discharge duct comprises a wall configured to encircle or to be encircled by a predetermined portion of the drain collar.

11. The laundry machine according to claim 10, wherein on an external side of said wall of the discharge duct at least a seat adapted to house at least one clamp member is provided, and wherein said clamp member is configured to tighten said wall against said at least one drain-connection element provided on the drain collar.

12. The laundry machine according to claim 11, wherein the discharge duct is made of an elastomeric material.

13. The laundry machine according to claim 1, wherein said at least one drain-connection element provided on the drain collar comprises a threaded portion or bayonet elements provided on said drain collar and configured to engage with a complementary threaded portion or bayonet element provided on said discharge duct.

14. The laundry machine according to claim 13, wherein said at least one drain-connection element provided on the drain collar comprises a sacrificial part provided on the drain collar and configured to be used for welding the discharge duct to the tub.

15. The laundry machine according to claim 1, wherein said at least one drain-connection element provided on the drain collar comprises a sacrificial part provided on the drain collar and configured to be used for welding the discharge duct to the tub.

16. The laundry machine according to claim 1, wherein the discharge duct is made of a hard polymer.

17. A laundry machine for treating laundry comprising a tub, said tub comprising:

a discharge hole for draining liquid out of the tub, a drain collar protruding outwardly from the tub at a periphery of the discharge hole;

a plurality of drain-connection elements comprising at least two different types of drain-connection elements, and a discharge duct having a connection arrangement fluidly connected to the discharge hole for collecting liquid drained from the tub, the discharge duct firmly fixed to said tub by at least one of said drain-connection elements, wherein each different drain-connection element is configured to fix a corresponding different type of connection arrangement of a discharge duct to said tub;

wherein at least one type of said at least two different types of drain-connection elements is provided on the drain collar in order to connect the discharge duct, the discharge duct comprising a wall configured to encircle a predetermined portion of the drain collar; wherein on an external side of said wall of the discharge duct at least a seat adapted to house at least one clamp member is provided, and wherein said clamp member is configured to tighten said wall against said at least one drain-connection element provided on the drain collar.

18. The laundry machine according to claim 17, wherein the discharge duct is made of an elastomeric material.

* * * * *